United States Patent [19]

Puccio

[11] 4,058,867

[45] Nov. 22, 1977

[54] UPLIFT RESTRAINT FOR COMPOSITE EXPANSION JOINT ASSEMBLY

[75] Inventor: Guy S. Puccio, Snyder, N.Y.

[73] Assignee: Acme Highway Products Corporation, Buffalo, N.Y.

[21] Appl. No.: 760,908

[22] Filed: Jan. 21, 1977

[51] Int. Cl.[2] ..... E01D 19/06

[52] U.S. Cl. ..... 14/16.5; 404/69; 52/396

[58] Field of Search ..... 404/69, 47, 68; 52/396; 14/16.5

[56] References Cited

U.S. PATENT DOCUMENTS

| | | | |
|---|---|---|---|
| 2,013,195 | 9/1935 | Ward | 14/16.5 |
| 3,482,492 | 12/1969 | Bowman | 14/16.5 X |
| 3,830,583 | 8/1974 | Becht | 14/16.5 X |
| 3,854,159 | 12/1974 | McLean | 14/16.5 |
| 3,880,540 | 4/1975 | Rizza | 404/69 |
| 3,904,303 | 9/1975 | Becht | 14/16.5 X |

*Primary Examiner*—Nile C. Byers

*Attorney, Agent, or Firm*—Christel & Bean

[57] ABSTRACT

A composite expansion joint assembly of alternating elastic sealing elements and rigid structural members slidably mounted on transversely extending support bars with uplift restraint assemblies associated therewith restricting vertical displacement of the structural members.

5 Claims, 4 Drawing Figures

UPLIFT RESTRAINT FOR COMPOSITE EXPANSION JOINT ASSEMBLY

BACKGROUND OF THE INVENTION

This invention relates to expansion joints and, more particularly, to composite expansion joints of the type employed in bridge deck constructions for accomodating movements between adjacent deck sections.

Composite expansion joints are conventionally used in those constructions, such as bridge structures and the like, wherein the relative movement between adjacent deck sections in response to temperature changes is too great to be accomodated by a single seal unit. These known composite expansion joints often consist of a series of laterally spaced elastic seals separated by rigid structural members or plates and extend lengthwise of the exapansion groove between the adjacent bridge deck sections.

In many of these prior composite joint assemblies, as disclosed in the U.S. Pat. Nos. 3,830,583 and 3,904,303 — Becht et al assigned to the assignee of the present invention, it has been recognized that the rigid structural members tend to shift vertically and sometimes tilt about the longitudinal axes thereof as traffic moves thereacross, causing distortion of the expansion joint assembly and creating undesirable noise. Often, an excess of friction is generated upon relative sliding movement of the various components, causing wear thereof and creating additional noise. It is known in the prior art to employ various types of uplift restraint assemblies to limit the potential vertical lift and tilt of the rigid structural members. Such structures have included the provision of brackets on the structural members for engagement underneath a portion of the support bars which support the rigid structural members. Such brackets include pad portions bolted thereon for engagement against the undersurface of the support bar. However, due to bridge vibration and other types of related movement, the bolted connections between the aforesaid brackets and pads tend to become loose and in general cannot be easily adjusted to maintain a predetermined degree of contact between the pad and the support bar.

SUMMARY OF THE INVENTION

Accordingly, it is an object of the present invention to provide an improved composite expansion joint assembly having an uplift restraint means overcoming the above noted disadvantages.

It is still another object of the present invention to provide the foregoing composite expansion joint assembly with means for restraining vertical and tilting movements of the structural members forming a part of this assembly while minimizing friction between the relatively movable components thereof for quietness in use.

The composite expansion joint assembly of this invention is characterized by the provision of a plurality of resiliently yieldable sealing elements adjacent ones of which are supported in laterally spaced relation by structural I-beam members slidably mounted on transversely extending support bars having opposite end portions projecting axially beyond the sides of the expansion groove. Specifically, the present invention provides an uplift restraint means for limiting vertical displacement of the structural I-beams relative to the underlying support bars while still insuring that these members may slide laterally with respect to one another. The uplift restraint means is structured so that the degree of engagement of the I-beams against the support bars may be selectively adjusted. In addition, the structure of the uplift restraint insures that the adjustment means related thereto does not become altered due to bridge use and vibration associated therewith.

The foregoing and other objects, advantages and characterizing features of the present invention will become clearly apparent from the ensuing detailed description of an illustrative embodiment thereof, taken together with the accompanying drawings wherein like reference numerals denote like parts throughout the various views.

DETAILED DESCRIPTION OF AN ILLUSTRATIVE EMBODIMENT

Figure 1:
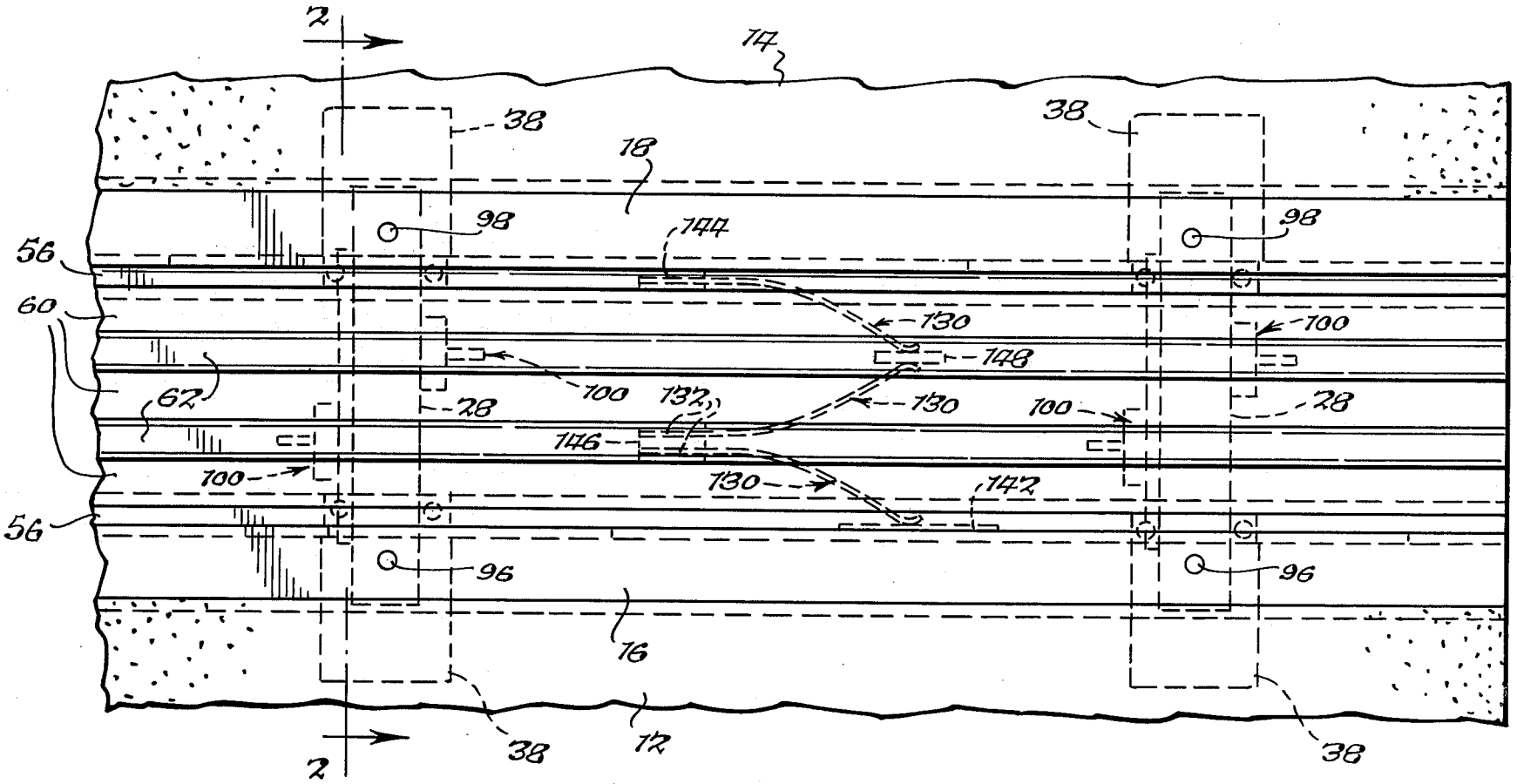
FIG. 1 is a plan view of a composite expansion joint assembly of indeterminant length, constructed in accordance with this invention, and shown disposed between a pair of bridge deck sections.

Referring to the illustrative embodiment depicted in the drawings, there is shown in FIG. 1 a composite expansion joint assembly generally designated 10, constructed in accordance with this invention and shown installed in an expansion groove of substantial width between adjacent bridge deck slabs or sections 12 and 14 formed of reinforced concrete or any other suitable material, which can extend downwardly to the bottom of joint assembly 10, or therebelow, as is dictated by the specific construction. Bridge deck sections 12 and 14 are provided with edge channels 16 and 18 permanently anchored in a conventional manner to the respective deck sections and which have opposed verticle faces 20 and 22 (FIG. 2) defining the lateral sides of the expansion groove in which expansion joint assembly 10 is installed. Joint assembly 10 extends across the width of the groove between faces 20 and 22 for the full length of the groove transversely to the length of sections 12 and 14.

The lower flanges of edge channels 16 and 18 are rigidly secured to horizontally extending plates 24 as by means of welding for example. A pair of bearing bars 26 are disposed against the inner faces 20 and 22 of edge channels 16 and 18 within the groove defined therebetween for slidably supporting a support bar 28, which extends transversely across the expansion groove and through specially configurated openings 30 provided in the lower portions of edge channels 16 and 18. Bearing bars 26 extend transversely of support bar 28 and are provided with slightly arcuately-shaped upper bearing surfaces 32. Bearing bars 26 are secured at their opposite ends by means of bolts 34 threaded into plates 24. Bolts 34 are provided with enlarged heads which serve to limit lateral movement of support bar 28.

A plurality of support bars 28 are provided and extend transversely across the expansion groove in laterally spaced apart relation lengthwise of the groove. Bars 28 support the anticipated loading on the expansion joint and are of size and spacing dictated by the particular application. The opposite ends of each support bar 28 support the anticipated loading on the expansion joint and are of a size and spacing dictated by the particular application. The opposite ends of each support bar 28 are enclosed within protective casings 38 built up from structural plates and projecting outwardly away from the expansion groove.

The support bar 28 comprises a generally flat-sided, solid body 40 having a bottom layer 42 of stainless steel for example, which slides on bearing bars 26. The upper surface of body 40 also is provided with a layer 44 of stainless steel to facilitate sliding movement of the I-beams thereon, as will hereinafter be described. These layers of stainless steel also offer resistance against corrosion to prolong the useful life of support bars 28. Support bars 28 are movable relative to bearing bars 56 during expansion and contraction of the joint upon expansion and contraction of bridge joint sections 12 and 14. A pair of studs 46 and 48 project laterally from the opposite sides of body 40 adjacent the opposite ends thereof and are engagable with the outer faces of edge channels 16 and 18 for limiting movement of support bar 28 in either axial direction. The upper sidewalls of support bar 28 are each provided with a laterally overhanging portion 40*a* for a purpose to be explained hereinbelow.

A pair of seal locking channel members 54 extend lengthwise of the expansion groove and have upper flanges 56 and lower flanges 58. The outer faces of channel members 54 are secured to vertical faces 20 and 22 of edge channels 16 and 18 respectively, as by means of welding for example.

Figures 2, 3, 4:
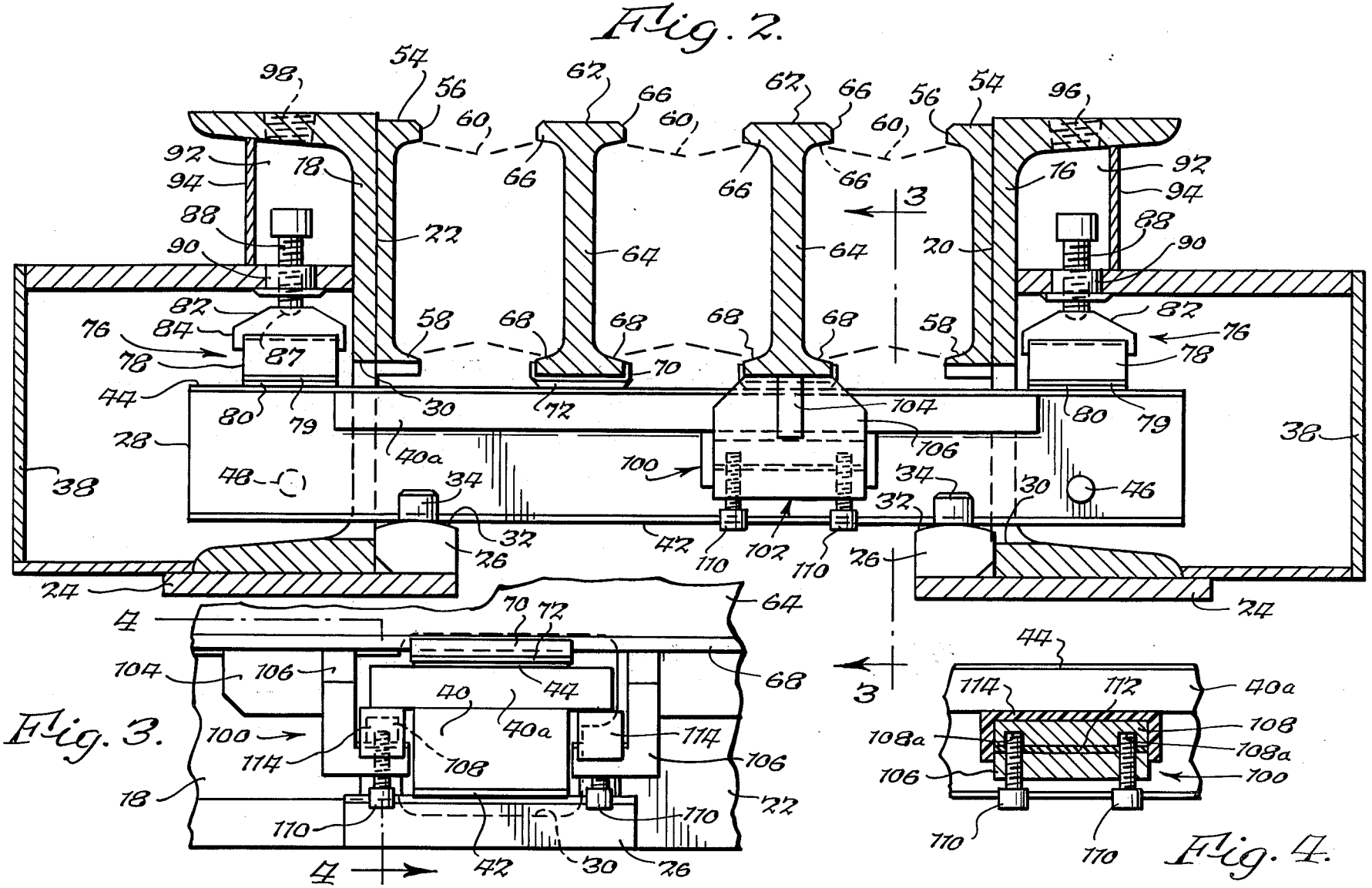
FIG. 2 is a transverse sectional view, on an enlarged scale, taken about on line 2—2 of FIG. 1.
FIG. 3 is a fragmentary, longitudinal sectional view, taken about on line 3—3 of FIG. 2.
FIG. 4 is a fragmentary, transverse sectional view, taken about on line 4—4 of FIG. 3.

A plurality of resiliently yieldable sealing elements 60 are disposed between seal locking channel members 54 with the outermost sealing element 60 received and positioned between flanges 56 and 58 of channel member 54 as shown in FIG. 2. A plurality of I-beam members or structural members 62 also are positioned within the space defined by the locking channels 54, there being an I-beam 62 interposed between each pair of adjacent sealing elements 60. While three such sealing elements 60 are shown in the illustrative embodiment depicted in FIG. 2, it should be understood that more or less than three sealing elements 60 can be utilized in the expansion joint of this invention, depending on the width of the expansion groove.

Sealing elements 60 comprise tubular members of elastomeric material each having an internal supporting truss structure which can take various configurations, and are secured to channel members 54 on the opposite sides of I-beam members 62 by a suitable adhesive, all in a manner well known in the art. Each I-beam member 62 is provided with a vertical web 64 and upper and lower flanges 66 and 68 extending laterally outwardly from opposite sides of web 64. These flanges 66 and 68 received and position the intermediate sealing element 60 in place.

I-beam members 62 are supported on bar 28 for lateral sliding movement relative thereto and the lower flanges 68 of I-beam members 62 are capped with bearing shoes 70 (FIG. 2) of generally U-shaped configuration adapted to conform to the shape of flanges 68 and attached thereto. These shoes 70 are spaced longitudinally along I-beam member 62 at substantially equal distances corresponding to the distance between support bars 28 and are in alignment therewith. The outer surface of the straight portion of each shoe 70 is provided with a layer of anti-friction, wear resistant material 72, such as filled polytetrafluoroethylene for example. The filled polytetrafluoroethylene layer 72 bearing against the stainless steel layer 44 on bar 28 reduces friction to a minimum, facilitating sliding movement between I-beams 62 and support bars 28 and dampens the noise therebetween. Of course, other suitable materials exhibiting similar anti-friction, wear resistant characteristics can be used in lieu of filled polytetrafluoroethylene if desired.

Means are provided for adjustably restraining support bars 28 against vertical lifting or bouncing on bearing bars 26. Such means comprise a pair of composite bearing block assemblies, generally designated 76, mounted in casings 38 and supported on the top surfaces of each support bar 28 adjacent the opposite ends thereof. Each assembly 76 includes a generally rectangular block 78 of a resiliently yieldable material, such as neoprene for example, an intermediate layer 79 of rigid material, such as steel, and an outer layer 80 of anti-friction, wear resistant material, such as filled polytetrafluoroethylene for example, engagable with the stainless steel lining 44 on the upper surface of support bar 28. Layers 79 and 80 can be adhesively secured by any suitable laminating process. A cap 82 is mounted on block 78 and is provided with dependent flanges 84 overlying the upper side portions of block 78. The inner surface of cap 82 is provided with a grid arrangement comprising intersecting ribs, adapted to be firmly impressed in the upper surface of block 78 for interlocking engagement therewith preventing relative sliding movement therebetween in a horizontal plane.

The upper surface of cap 82 is provided with a central, inwardly dished portion 87 adapted to receive the distal end of an adjustment screw 88 threaded through a bushing 90 mounted in the top wall of casing 38. Screw 88 is effective to adjust the bearing pressure on support bar 28. The exposed portion of screw 88 is protectively encased in a compartment 92 defined by the top wall of casing 38, the upper web portion and upper flange of the edge channel, and cover plates 94 fixedly secured at their opposite ends to the casing top wall and the edge channel upper flange. In order to gain access to the heads of screws 88, openings 96 are provided in the upper flanges of edge channels 16 and 18. Suitable plugs 98 are threaded into openings 96 to prevent dirt and other debris from entering into compartment 92. Thus, restraining assembly 76 bears against support bar 28 to hold such bars 28 firmly against their associated bearing bars 26 and restrict vertical lifting thereof or bouncing on bearing bars 26. The resiliently yieldable material of which block 78 is formed serves to dampen or cushion vertical movements of support bar 28 thereby reducing noise caused by vehicle traffic on the bridge deck. Also, the low friction characteristic of the filled polytetrafluoroethylene layer 80 facilitates sliding movement between support bar 28 and restraining block assembly 76.

I-beam members 62 are held against unrestrained mounting on support bars 29. To this end, a plurality of uplift restraint assemblies, generally designated 100, are connected to the bottom surfaces of I-beam members 62 for restraining or limiting vertical displacement of the I-beam members relative to the support bars 28. Such uplift restraint assemblies 100 are spaced longitudinally along I-beam member 62 so that at least one assembly 100 is provided for cooperation with the overhang portion 40*a* of each support bar 28. As shown in FIGS. 2 and 3, each uplift restraint assembly 100 comprises a bracket 102 welded or otherwise fixedly secured to the bottom surface of I-beam member 62 and has a web 104 and a right angularly related plate 106 extending outwardly from web 104. Plate 106 is of L-shaped configuration when viewed in cross-section, as in FIG. 3 for example, having a downwardly depending leg portion and a laterally or horizontally extending leg portion which is disposed beneath the overhang portion of 40*a* of support bar 28. A pad means 108 is disposed between the upper surface of the laterally extending leg portion of bracket 106 and the undersurface of portion 40*a* of the support bar. Adjustment means shown in the form of bolts 110 are threaded through the horizontal leg portion of the bracket plate 106 and are received in correspondingly aligned open cavities 108*a* in the pad means. By means of the threaded reception of the bolts 110 in plate 106, the pad 108 may be urged upwardly into engagement beneath and against support bar portion 40*a* and necessarily the degree of such engagement in a vertical direction may be selectively varied by use of the bolts 110. When pad 108 is formed of steel for example, it is considered advantageous to coat the top and side surfaces thereof with urethane material for example so as to insure facilitated sliding movement between pad 108 and the support bar. In addition, the urethane material serves to resiliently dampen any potential looseness in the engagement of the uplift restraint against the support bar as does the placement of a neoprene gasket between pad 108 and the horizontal portion of bracket plate 106. Necessarily, the neoprene gasket 112 and urethane coating 114 insure that the uplift restraint is quiet in operation. As will become clearly apparent in describing the operation of the present invention, it is considered a distinct advantage that the bolts 110, as viewed in FIG. 3, are located directly below the vertical loading on pad 108 imparted thereto by portion 40*a* of the support bar.

Also, the engagement of the pads 108 with support bar portions 40*a* at spaced points therealong prevents tilting of I-beam members 62 about their longitudinal axis, which might otherwise occur as a result of forces caused by vehicle traffic and/or vehicle braking. Therefore, the uplift restraints, together with restraining block assemblies 76, prevent possible deterioration of support bars 28 and I-beams 62 consequent upon unrestrained bouncing, and virtually elimates the problem of noise.

Means are provided at longitudinally spaced intervals along expansion joint assembly 10 for equalizing the lateral movements of sealing elements 60 during compression and expansion thereof. To this end, a plurality of laterally aligned, heavy-duty leaf springs 130, corresponding in number to the number of sealing elements 60 employed, are mounted below the latter to transmit excessive pressure imparted to one of these sealing elements 60 to the other thereof. As shown in FIG. 1, each of these springs is provided with a flat end portion 132, an elongated intermediate curved portion 138, and a reversely bend end portion 140.

The means for mounting springs 130 include a pair of plates 142 and 144 welded or otherwise fixedly secured to vertical faces 20 and 22 of edge channels 16 and 18 below channel numbers 54. I-beam members 62 are provided with depending plates 146 and 148, respectively, rigidly secured to the bottom surfaces thereof. As shown in FIG. 1, plates 144 and 146 are in lateral alignment and longitudinally offset from plates 142 and 148, which also are in lateral alignment. The flat end portions 132 of the springs are secured to plate 146 by means of clamping means. The intermediate curved portions 138 of springs 130 diverge away from each other, as shown in FIG. 1, and the respective end portions 140 bear against plates 142 and 148. These springs 130 insure uniform lateral movement of sealing elements 60 during expansion and contraction thereof. Excessive pressures, accompanied by excessive lateral movement, imparted to one of the sealing elements 60 will be transmitted through these springs 130 and I-beam members 62 to the other sealing elements 60 to equalize pressure acting thereon, thereby providing uniform lateral movement throughout.

In use, sealing elements 60 of composite expansion joint assembly 10 are compressed and expanded to accommodate relative movement of bridge deck sections 12 and 14 toward and away from each other while maintaining pressure engagement against channels 54 and I-beam members 62. The joint movement of the composite expansion joint assembly of the present invention is the sum of the movements of sealing elements 60. Since a typical sealing element shown in the illustrative embodiment can be compressed two inches under maximum compression, the total movement in the illustrated expansion joint assembly will be 6 inches. The number of sealing elements 60 and I-beam members 62 can of course vary as dictated by the total movement required for a specific application. Upon movement of deck sections 12 and 14 away from each other, the reverse action occurs. I-beam members 62 will move substantially uniformly due to the leaf spring arrangement. It will be appreciated that the expansion joint assembly is shown fully expanded in FIG. 3.

During expansion and contraction of the joint assembly as described hereinabove, it becomes readily apparent that the I-beam members 62 undergo relative sliding movement with respect to the support bars 28. The adjustable uplift restraint means 100 are selectively engaged against the undersurface of support bar portion 40*a* to urge the support bars and I-beams into a predetermined degree of engagement against one another. Of primary importance in the present invention is the fact that the adjustment means in the form of bolts 110 are disposed directly below the point of loading thereon as imparted by the engagement of pad 108 with the under surface of portion 40*a*. Such direct loading on the bolts serves to lock bolts in a set position so that the selected degree of engagement of the pad 108 with the support bar does not change during use. Accordingly, the uplift restraint may be torqued against the support bar so that there is intimate contact while providing a relatively frictionless sliding surface by means of the urethane coating 114. The direct loading on bolts 110 is to be contrasted to uplift adjustment means laterally offset from the point of loading on pad 108 which were difficult to operate in a manner so as to insure their being locked in place during use.

From the foregoing, it is apparent that the objects of the present invention have been fully accomplished. As a result of this invention, an improved uplift restraint means is provided for maintaining a preselected degree of sliding contact between the structural I-beams and underlying support bars of the composite expansion joint assembly described hereinabove.

Having thus described and illustrated a preferred embodiment of my invention, it will be understood that such description and illustration is by way of example only and that such modifications and changes as may suggest themselves to those skilled in the art are in-tended to fall within the scope of the present invention as limited only by the appended claims.

I claim:

1. In a composite expansion joint assembly comprising:

a pair of edge members adapted to define the opposite sides of an expansion groove between bridge deck sections;

said edge members having corresponding, elongated openings extending lengthwise of said edge members; laterally spaced support bars extending transversely of said groove with the opposite ends of said bars extending through said openings beyond the opposite sides of said groove;

a plurality of elongated resiliently yieldable sealing elements in a side-by-side relation extending longitudinally of said groove;

elongated rigid structural members interposed between said sealing elements and extending lengthwise thereof;

said structural members being supported above said support bars for lateral sliding movement relative thereto; and uplift restraint means on at least one of said structural members and said support bars for limiting vertical displacement of the former relative to the latter, said uplift restraint means including bracket means affixed to said structural member and extending beneath a portion of said support bar, a pad means supported by said bracket means for engagement beneath and against a portion of said support bar, and adjustment means associated with said bracket means and operable with said bracket means and said pad means for selectively varying in a vertical direction the degree of engagement of said pad means against said support bar, said adjustment means being vertically located beneath said portion of said support bar engaged by said pad means.

2. In an assembly as set forth in claim 1, said bracket means being of generally L-shaped configuration so as to depend downwardly from said structural member and laterally beneath said portion of said support bar engaged by said pad means wherein said pad means is disposed between said laterally extending portion of said bracket means and said support bar.

3. In an assembly as set forth in claim 2, said adjustment means being threaded so as to be selectively movable in a vertical direction.

4. In an assembly as set forth in claim 3, the portion of said pad means engagable beneath and against a portion of said support bar being covered with a generally frictionless material so as to eliminate vibration and noise between said pad means and support bar.

5. In an assembly as set forth in claim 3, further including an elastomeric gasket means disposed between said laterally extending portion of said bracket and said pad means so as to eliminate vibration and noise therebetween.

* * * * *